US008336227B2

(12) United States Patent
Bae et al.

(10) Patent No.: US 8,336,227 B2
(45) Date of Patent: Dec. 25, 2012

(54) LAUNDRY DRYER HAVING FRAGRANCE STORAGE AND SUPPLY ASSEMBLY

(75) Inventors: Sang-Hun Bae, Changwon (KR); Min-Ji Kim, Changwon (KR); Ye-Ji Um, Changwon (KR); Myung-Shik Kim, Changwon (KR); Young-Soo Ha, Changwon (KR)

(73) Assignee: LG Electronics Inc., Seoul (KR)

( * ) Notice: Subject to any disclaimer, the term of this patent is extended or adjusted under 35 U.S.C. 154(b) by 614 days.

(21) Appl. No.: 12/585,843

(22) Filed: Sep. 25, 2009

(65) Prior Publication Data

US 2010/0077633 A1 Apr. 1, 2010

Related U.S. Application Data

(60) Provisional application No. 61/136,712, filed on Sep. 26, 2008.

(30) Foreign Application Priority Data

Sep. 26, 2008 (KR) ..... 10-2008-0094957

(51) Int. Cl.
*F26B 19/00* (2006.01)

(52) U.S. Cl. ..... 34/601; 34/610; 312/326; 68/17 R

(58) Field of Classification Search ..... 34/90, 601, 34/606, 610, 595; 312/228.1, 326; 68/5 R, 68/17 R; 439/152
See application file for complete search history.

(56) References Cited

U.S. PATENT DOCUMENTS 2,807,893 A * 10/1957 Morey ..... 34/597
3,267,701 A * 8/1966 Mandarino ..... 68/12.15
5,875,655 A * 3/1999 Herman-Latack et al. ... 68/17 R
7,735,345 B2 * 6/2010 Wright et al. ..... 68/13 R
7,802,855 B2 * 9/2010 Calmeise ..... 312/228
7,823,422 B2 * 11/2010 Bextermoeller et al. .... 68/12.26
7,900,486 B2 * 3/2011 Richman et al. ..... 68/17 R
8,225,528 B2 * 7/2012 Yoon et al. ..... 34/603
2009/0053119 A1 * 2/2009 Richman et al. ..... 422/300

(Continued)

FOREIGN PATENT DOCUMENTS

DE 102006003416 7/2007

(Continued)

*Primary Examiner* — Stephen M. Gravini

(74) *Attorney, Agent, or Firm* — McKenna Long & Aldridge LLP

(57) ABSTRACT

A drum rotatably disposed within a cabinet, a door coupled to a front of the cabinet, a front supporter to support a side of the drum, and a fragrance storage and supply assembly disposed on the front supporter and comprising a receiving part that is rotatably installed within the cabinet. A cabinet defining an outer appearance of the laundry dryer, a drum rotatably installed in the cabinet, a door to open and close a laundry passage formed by an opening in the cabinet that is configured for passage of laundry into and out of the drum, a fragrance storage and supply assembly comprising a receiving assembly to receive liquid fragrance, a storage chamber, remote from the receiving part, to store the liquid fragrance, a mount fixed to the cabinet, a hinge, rotatably joining the mount and the receiving part, wherein the receiving part rotates about the hinge from a space within an interior of the laundry dryer to a space exterior to the laundry dryer. The laundry dryer further comprises a storage chamber to store liquid fragrance. Additionally, the storage chamber is provided with a level detector for detecting an amount of fragrance solution remaining in the storage chamber.

19 Claims, 7 Drawing Sheets

U.S. PATENT DOCUMENTS

| | | | | |
|---|---|---|---|---|
| 2010/0077633 | A1* | 4/2010 | Bae et al. | 34/90 |
| 2011/0083338 | A1* | 4/2011 | Carow et al. | 34/329 |
| 2011/0146102 | A1* | 6/2011 | Bellinetto et al. | 34/549 |
| 2012/0019114 | A1* | 1/2012 | Hong et al. | 312/228.1 |
| 2012/0074121 | A1* | 3/2012 | Gagas et al. | 219/385 |
| 2012/0144689 | A1* | 6/2012 | Ghosh et al. | 34/389 |

FOREIGN PATENT DOCUMENTS

| | | |
|---|---|---|
| EP | 1862584 | 12/2007 |
| EP | 1887127 | 2/2008 |
| KR | 1994-006072 | 3/1994 |
| KR | 10-2007-0037127 A | 4/2007 |
| KR | 10-2008-0027699 A | 3/2008 |

* cited by examiner

LAUNDRY DRYER HAVING FRAGRANCE STORAGE AND SUPPLY ASSEMBLY

This application claims priority to Korean Patent Application No. 10-2008-0094957 and U.S. Provisional Application No. 61/136,712, both filed on Sep. 26, 2008, which are each hereby incorporated by reference for all purposes as if fully set forth herein.

BACKGROUND OF THE INVENTION

1. Field of the Invention

The invention relates to a laundry dryer, and particularly, to a laundry dryer having a fragrance storage and supply assembly capable of injecting (by, for example, spraying) liquid fragrance into a drum of the laundry dryer.

2. Discussion of the Related Art

Laundry dryers (referred to generally herein as dryers) are apparatuses constructed to accommodate washed and partially dehydrated laundry, such as for example clothing and towels, in a rotating drum while hot air is blown into the drum to evaporate moisture from the laundry for drying.

A laundry dryer typically includes a drum installed inside a dryer cabinet. The drum receives and accommodates laundry. The dryer also typically includes a driving motor for driving the drum, a fan for blowing air into the drum, and a heating member for heating air introduced into the drum. The heating member may use either electricity, which generates high temperature air by using an electric resistance, or a combustion process, which generates high temperature by burning gas.

Air coming out of the drum of the dryer contains moisture from the partially dehydrated laundry inside the drum. The air coming out of the drum is humid and of a high temperature. Dryers may be classified according to how they process this hot, humid air into condensation-type dryers and ventilation-type dryers. Condensation-type dryers are configured to provide heat-exchange between external cooler air, and the hot, humid air circulating within the dryer. In a condensation-type dryer, the hot, humid air is made to condense to remove moisture contained in the air. Ventilation type dryers are configured to discharge the hot, humid air flowing through the drum to an outside of the cabinet housing the drum.

In some cases, after laundry has been washed in a washer and introduced into the dryer for drying, a smell of used washing water, detergent, or a pre-existing smell in the laundry before washing, may remain in the laundry even after the moisture contained in the laundry is evaporated. This smell may be unpleasant or unwanted by a user. Accordingly, fragrance may be supplied into the drum to remove remaining smells in the laundry and allow user to feel clean and refreshed when wearing/using the laundry. However, some devices for supplying fragrance are complicated or a fragrance source requires constant refilling as it is consumed in cooperation with the operation of the dryer. In these cases, the user may be confronted with the problem that it is not easy to refill the liquid fragrance into the fragrance storage and supply device.

SUMMARY OF THE INVENTION

To achieve advantages over the related art and in accordance with the purpose of the invention, the following features and advantages of the invention are exemplified by the embodiments described.

In one embodiment, a laundry dryer may be comprised of a drum rotatably disposed within a cabinet, a door coupled to a front of the cabinet, a front supporter configured to support a side of the drum; and a fragrance storage and supply assembly disposed on the front supporter, the fragrance storage and supply assembly comprising a receiving part that is rotatably installed within the cabinet.

In this or other embodiments, the receiving part may be coupled to the front supporter by a hinge and may be provided with a hollow portion configured to receive a liquid fragrance poured therein. The receiving part may be provided with a handle extending along a side thereof such that the handle is visible from an outside of the dryer when the door is opened. The fragrance storage and supply assembly may further comprise a storage chamber configured to store the liquid fragrance solution introduced into the hollow portion of the receiving part. The storage chamber may be provided with a level sensor configured to detect a level of the liquid fragrance solution stored therein.

In some embodiments, the handle of the receiving part may be provided with a display to display a level of fragrance solution in the storage chamber detected by the level sensor. A display of a control panel of the dryer may be configured to display a level of fragrance solution in the storage chamber detected by the level sensor. In some embodiments, the storage chamber may have a side through which an amount of fragrance solution remaining in the storage chamber is discernable. The side of the storage chamber, through which an amount of fragrance solution remaining in the storage chamber is discernable, may be visible from an outside of the dryer when the dryer's door is open.

In some embodiments, the dryer may further comprise a pump fluidly coupled to the storage chamber, and a nozzle fluidly coupled to the pump, the nozzle configured to dispense liquid fragrance solution into the drum.

In some embodiments, the front supporter may be provided with a cover configured to cover and uncover the hollow portion of the receiving part in cooperation with rotation of the receiving part. A sealing member may be disposed on a lower surface of the cover to form a seal between a bottom of the cover and a top of the hollow portion. In some embodiments, the receiving part may be provided with a cap attached thereto by a connection member, wherein the cap is configured to cover and uncover the hollow portion of the receiving part.

In still other embodiments, a laundry dryer may include a cabinet defining an outer appearance of the laundry dryer, a drum rotatably installed in the cabinet and configured to contain laundry therein, a door to open and close a laundry passage, the laundry passage formed by an opening in the cabinet that is configured for passage of laundry into and removal of laundry from the drum, a fragrance storage and supply assembly configured to dispense a liquid fragrance into the drum, the fragrance storage and supply assembly comprising a receiving part configured to receive the liquid fragrance therein, a storage chamber, remote from the receiving part, in fluid communication with the receiving part, and configured to store the liquid fragrance received by the receiving part, a mount, coupled to the cabinet, a hinge, rotatably joining the mount and the receiving part, wherein the receiving part may be configured to rotate about the hinge from a space within an interior of the laundry dryer to a space exterior from the laundry dryer.

In any embodiment, a control panel for displaying an operating state of the dryer may be provided at an upper portion of a front surface of the cabinet, and the control panel may be provided with a display or indicator for displaying an amount of fragrance solution detected by the level detector of the storage chamber.

As will be understood, an amount of fragrance solution contained in the storage chamber can be checked by viewing information displayed, depending on the embodiment, on the handle, the control panel, or by viewing a window on a side of the storage chamber through which an amount of fragrance solution is viewable. The laundry dryer may further include a pump coupled to the storage chamber, and a nozzle coupled to the pump, via a tube, to inject fragrance into the drum.

The laundry dryer according to the embodiments of the invention includes the fragrance storage and supply assembly configured such that the inlet or storage chamber is rotatable. Accordingly, when fragrance is needed to be refilled, the receiving part may be rotated outwardly from the cabinet, which makes it easy for a user to pour liquid fragrance solution into the receiving part. Also, it is facilitated to determine whether the fragrance solution should be refilled.

The foregoing and other features, aspects, and advantages of the embodiments of the invention should become apparent from the following detailed description when taken in conjunction with the accompanying drawings.

BRIEF DESCRIPTION OF THE DRAWINGS

The accompanying drawings, which are included to provide a further understanding of the invention, and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

A description will now be given in detail of a laundry dryer in accordance with an embodiment of the invention, with reference to the accompanying figures.

Figure 1:
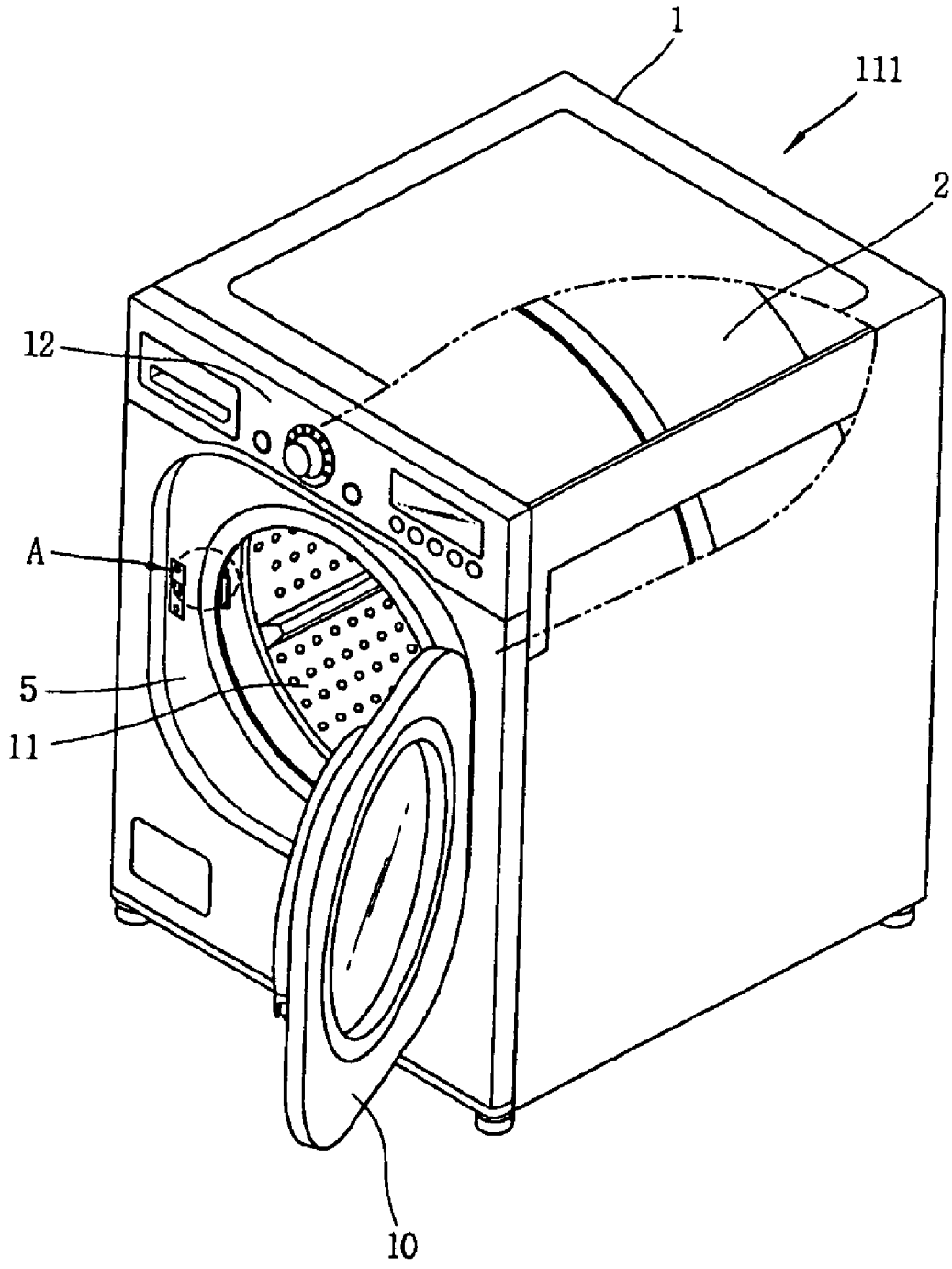
FIG. 1 is a perspective view showing an outside of a laundry dryer in accordance with an embodiment of the invention.
Figure 2:
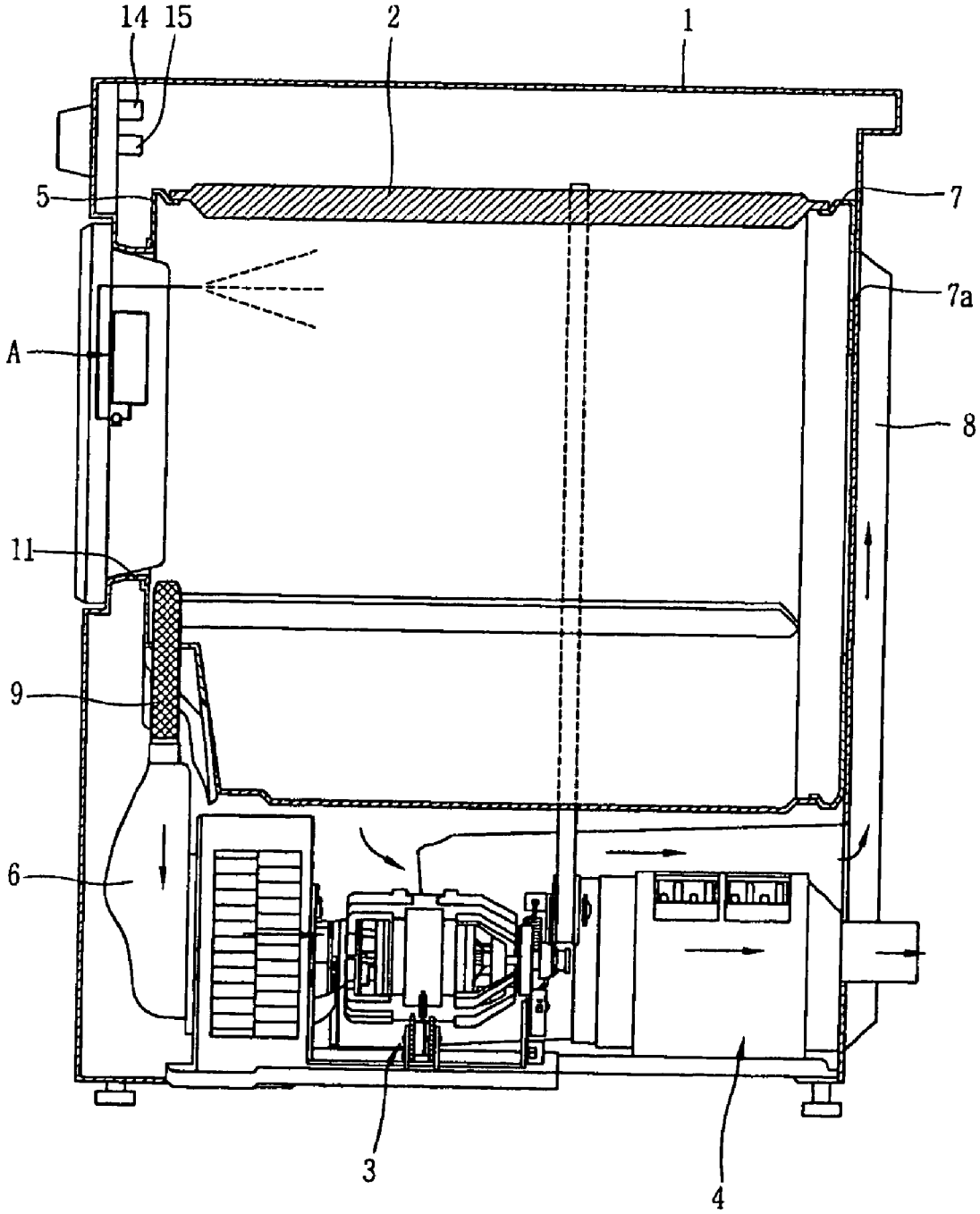
FIG. 2 is a longitudinal cross-sectional view showing an inside of the laundry dryer of FIG. 1.

FIG. 1 is a perspective view showing an outside of a laundry dryer in accordance with an embodiment of the invention, and FIG. 2 is a longitudinal cross-sectional view showing an inside of the laundry dryer of FIG. 1. As shown in FIGS. 1 and 2, a laundry dryer in accordance with an embodiment of the invention may include a cabinet 1 defining an outer appearance of the laundry dryer 111, a drum 2 rotatably installed in the cabinet 1 and configured to contain laundry therein, a hot air supplying unit 3 for generating hot air to be supplied into the drum 2, and a heat exchanger 4 for removing moisture contained in the hot, humid air discharged from the drum 2.

An opening in the cabinet 1, coinciding with an open front portion of the drum, defining a laundry passage 11 and a door 10 to open and close the laundry passage 11 may be provided for allowing a user to place laundry into the drum 1. The laundry passage 11 may be disposed at a front surface of the cabinet 1. A front supporter 5 for supporting a front side of the drum 2 may be installed around an inside surface of the laundry passage 11. An exhaust duct 6 for guiding humid air exiting the drum 2 may be disposed below the front supporter 5. A rear supporter 7 for supporting a rear side of the drum 2 may be disposed at a rear wall surface in the cabinet 1. An air supply hole 7*a*, through which heated air is supplied into the drum 2, may be formed at the rear supporter 7. A duct 8 may be disposed between the hot air supplying unit 3 and the air supply hole 7*a* to communicate hot air from the hot air supplying unit into the drum 2. Hot air supplying unit 3 may therefore be installed at an inlet side of the duct 8. Further, a control panel 12 having a display to show, for example, an operation state of the dryer, and control buttons, knobs, or other user interfaces of the dryer may be disposed at an upper portion of a front surface of the dryer. A controller 14 and memory 15 may be included on an inside surface of the control panel 12. The controller 14 may execute commands stored in the memory 15 to cause the dryer to operate and to monitor the dryer during operation.

A lint filter 9, for filtering foreign materials out of air circulating inside the exhaust duct 6, may be disposed in a portion of the front supporter 5. Reference numeral A, in FIGS. 1 and 2, denotes a position on the inside surface of front supporter 5 where the fragrance storage and supply assembly 300 may be disposed, in accordance with an embodiment of the invention. It is noted that other positions are within the scope of the invention. Any selected position preferably allows at least a portion of the fragrance storage and supply assembly 300 to be accessed from an outside of the dryer, such that it can be readily refilled.

Figure 3:
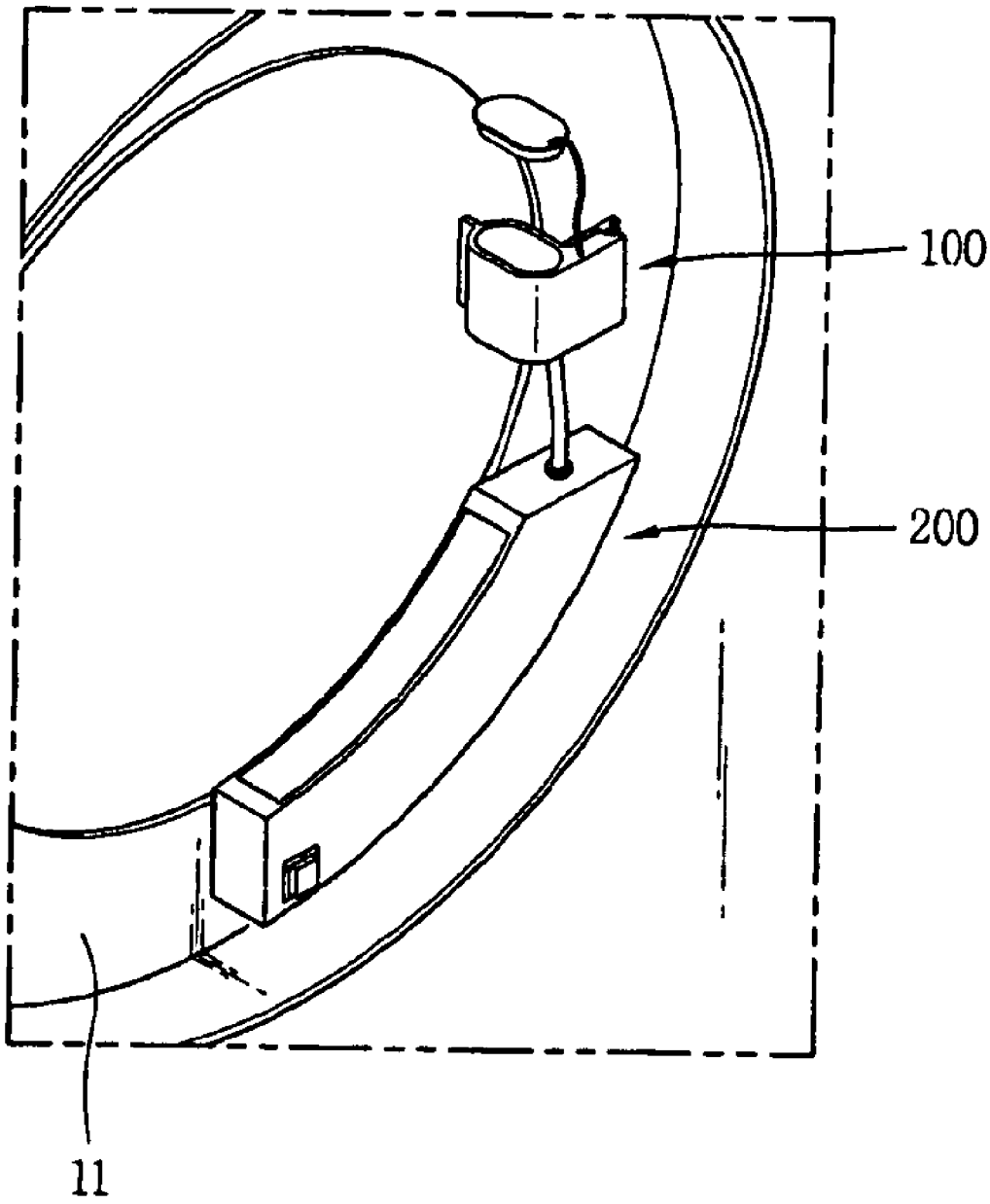
FIG. 3 is a view directed from the inside of the laundry dryer's drum toward the laundry passage, in accordance with an embodiment of the invention.

FIG. 3 is a view directed from the inside of the laundry dryer's drum 2 toward the laundry passage 11, in accordance with an embodiment of the invention. FIG. 3 illustrates that a fragrance storage and supply assembly 300 according to an embodiment of the invention may be mounted to an inner surface of the front supporter 5 of the dryer. In FIG. 3, only a receiving assembly 100 and a storage chamber 200 of the fragrance storage and supply assembly 300 are illustrated, for simplicity of the illustration.

Figure 4:
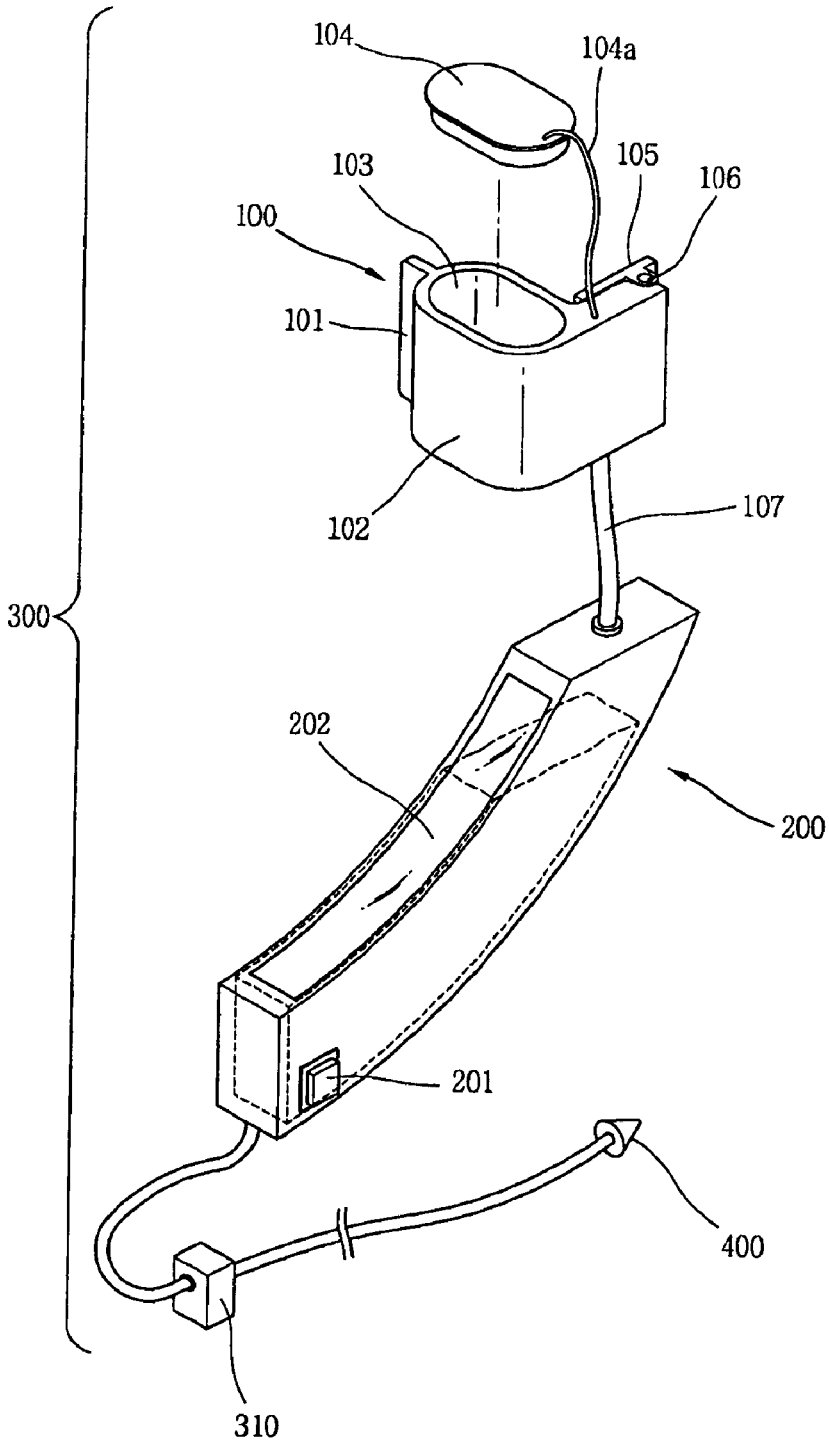
FIG. 4 is a perspective view showing the overall fragrance storage and supply assembly of FIG. 3, in accordance with an embodiment of the invention.

FIG. 4 is a perspective view showing the overall fragrance storage and supply assembly 300 of FIG. 3, in accordance with an embodiment of the invention. As shown in FIG. 4, the fragrance storage and supply assembly 300 may include a receiving assembly 100 into which a liquid fragrance solution may be poured. The fragrance storage and supply assembly 300 may further include a storage chamber 200 for containing the fragrance solution, and a supplying device 310 for supplying the fragrance solution to a nozzle 400 by applying a preset pressure. The supplying device 310 is preferably configured as a pump. The storage chamber 200 defines a space that receives the liquid fragrance solution that is poured into the receiving assembly 100 and has flowed through tube 107.

Figure 8:
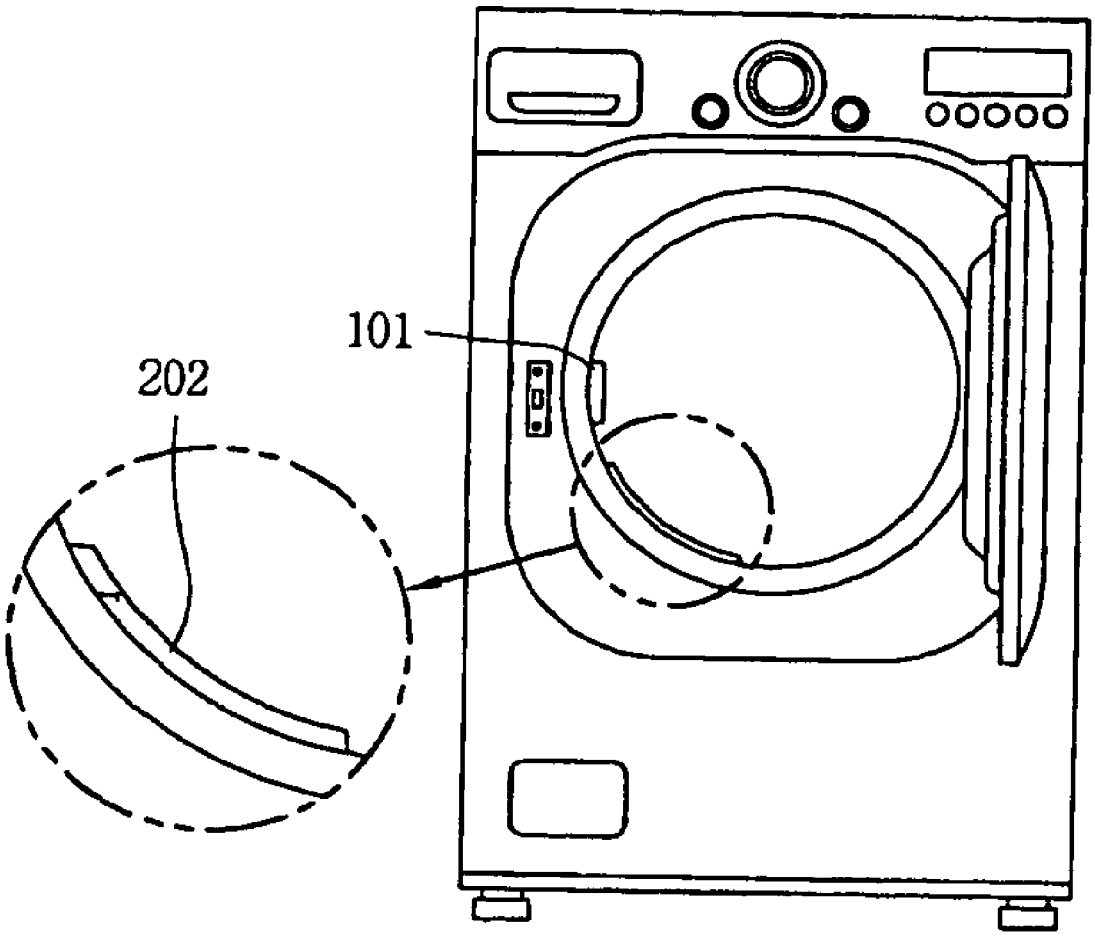
FIG. 8 illustrates one possible configuration of an embodiment of the invention, where one side surface of a storage chamber may be configured to be transparent or semi-transparent and to protrude upwardly from a front supporter such that it can be viewed from outside of the dryer when the dryer's door is opened.

FIG. 8 illustrates one possible configuration of an embodiment of the invention, where one side surface 202 (also referred to herein as window 202) of the storage chamber 200 may be configured to be transparent or semi-transparent and to protrude upwardly from the front supporter 5 such that it can be viewed from outside of the dryer when the dryer's door 10 is opened. Because the side surface 202 of the storage chamber 200 may be viewed when the door 10 is open, the amount of the fragrance solution remaining in the storage chamber 200 can be discerned by a user when the door 10 is open. Hence, the user can check when the fragrance solution is low by opening the door 10, therefore immediately knowing when it is necessary to refill the storage chamber 200.

Alternatively, a level sensor 201, for detecting a level (remaining volume) of fragrance solution, may be disposed at a lower portion of the storage chamber 200 and may be operationally coupled to the controller 14. When the volume of fragrance solution contained in the storage chamber 200 does not reach a preset level, the level sensor 201 may signal this state to the controller 14. The controller 14 may then cause the display of control panel 12 to indicate this low fragrance level state to a user. Alternatively, the level sensor 201 may cause an indicator (not shown) on the control panel 12 to indicate the low fragrance level state via a direct connection to the indicator. In any embodiment, such an indication may be displayed for the user on the control panel 12 at an upper portion of the front surface of the dryer.

The receiving assembly 100 in accordance with an embodiment of the invention may be comprised of a receiving part 102 provided with a hollow portion 103 for receiving liquid fragrance solution that is introduced to the receiving assembly 100. Further, the receiving assembly 100 may be provided with a handle 101 formed along a side of the receiving part 102. A lower portion of the hollow portion 103 may be in fluid communication with the tube 107 so that the fragrance solution poured into the receiving assembly 100 can flow into the storage chamber 200. Another side of the receiving assembly 100 may be coupled to a coupling member 105 fixed to the front supporter 5 by a hinge 106. The coupling member 105 may be fixed to the front supporter 5 by using fixing elements, such as screws, bolts, adhesive, or the like (not shown). The hinge 106 may allow the receiving part 102 to rotate with respect to coupling member 105. In the embodiment illustrated, the receiving part 102 may be caused to rotate about the hinge 106 when a user exerts a force on the handle 101.

While the receiving assembly 100 is shown to be located at the front supporter 5, it is envisioned that the receiving assembly 100 may be located anywhere that is accessible to the user such that it may be refilled. For example, the receiving assembly 100 (or only the receiving part 102) may be located apart from the storage chamber 200, at an upper portion of the dryer, such that it is accessible to the user through a front or upper surface of the cabinet 1. In this situation, the length of tube 7 would be increased. Further, it is envisioned that storage chamber 200 may be disposed in a location other than at the front supporter 5. For example, where level sensor 201 is employed and it is not necessary for the user to view a level of liquid therein through side 202, the storage chamber may be disposed in various locations within cabinet 1, so long as it is in fluid communication with supplying device 310.

Figure 5A:
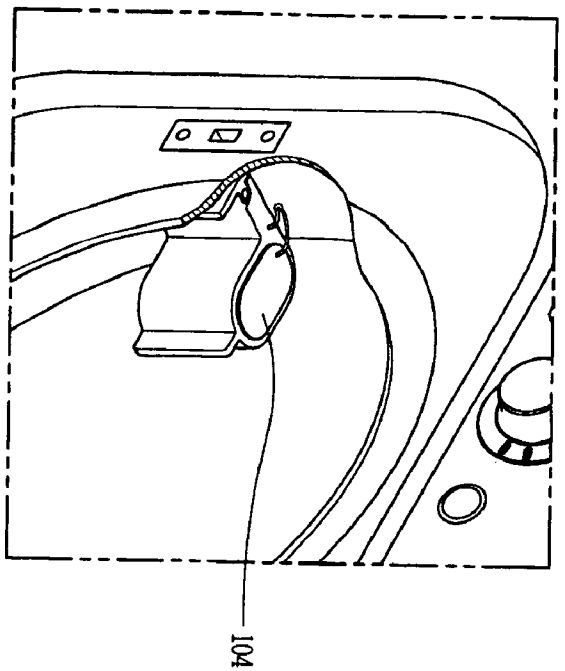
FIGS. 5A and 5B illustrate the rotation of a receiving part of a receiving assembly about a hinge from a space inside the laundry dryer to a space outside of the laundry dryer (or vice versa), all in accordance with an embodiment of the invention.
Figure 5B:
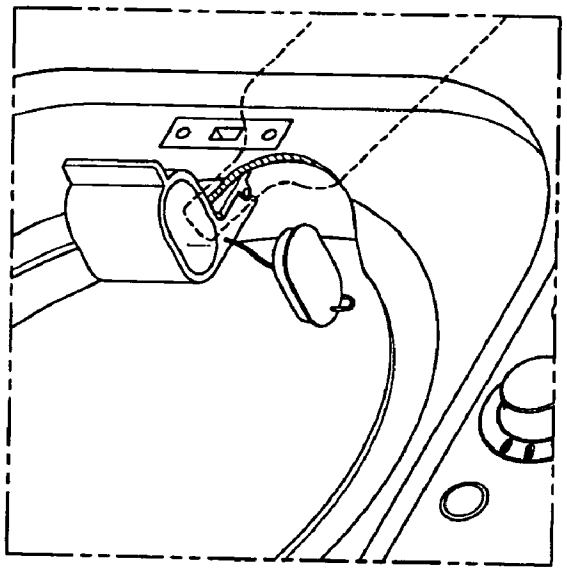

According to the embodiment illustrated in FIGS. 5A and 5B, in order for a user to add fragrance solution into the storage chamber 200, the user can rotate the receiving part 102 about hinge 106 to a certain angle by grasping the handle 101 and pulling the receiving part 102 toward an outside of the cabinet 1 so that the receiving part 102, with its hollow portion 103, is in a convenient position for the user to pour in the liquid fragrance solution. Further, the receiving assembly 100 may be provided with a cap 104 for covering the hollow portion 103 to prevent loss of the fragrance solution by evaporation. The cap 104 may be connected to the receiving assembly 100 by a connection member 104*a*. Connection member 104*a* may aid in preventing the loss of the cap 104.

FIGS. 5A and 5B illustrate the rotation of a receiving part 102 of a receiving assembly 100 about a hinge 106 from a space inside the laundry dryer to a space outside of the laundry dryer (or vice versa), all in accordance with an embodiment of the invention. FIG. 5A illustrates the receiving part 102 covered with the cap 104. The cap 104 may cover the hollow portion 103 of the receiving part 102 before and after the receiving assembly 100 receives fragrance solution. The cap 104 prevents evaporation of the liquid fragrance solution and also prevents debris, for example lint, from entering the hollow portion 103. The position of the receiving assembly 100 illustrated in FIG. 5A may be referred to as an "accommodation position," which may be used when the dryer performs normal operations. Normal operations may include the operation of injecting fragrance into the drum, for example, by operation of the supplying device 310.

If it is desired to add more fragrance solution to the dryer, such as after the dryer operates enough times to deplete the fragrance solution stored in the storage chamber 200, then the user may refill the storage chamber 200 by grasping handle 101 of receiving assembly 100 and rotating the receiving portion 102 outwardly, about hinge 106, from the front supporter 5. Then, the cap 104 of the receiving assembly 100 may be removed so that a user may pour the liquid fragrance solution into the receiving assembly 100. This position of the receiving assembly 100 is illustrated in FIG. 5B, and may be referred to as a "filling position." An element represented with a dotted line in FIG. 5B denotes a bottle or container containing the liquid fragrance solution. The drawing shows how the liquid fragrance solution contained in the bottle may be poured into the receiving assembly 100.

Figure 6:
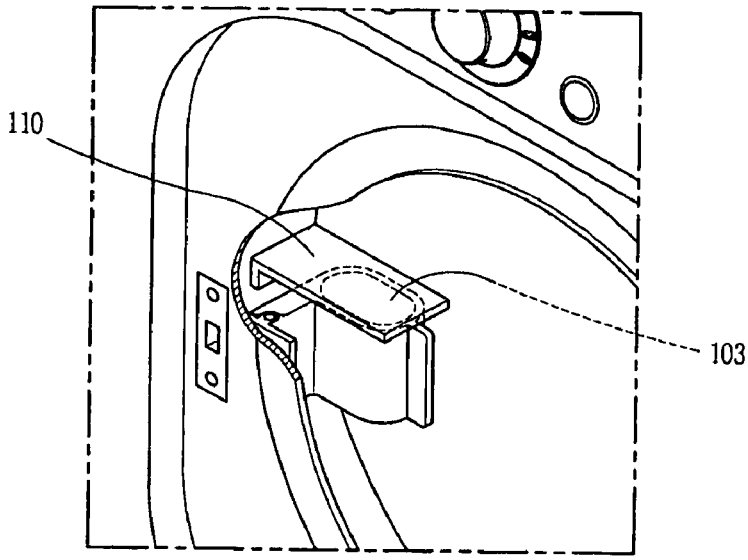
FIG. 6 illustrates a fragrance storage and supply assembly 300 in accordance with another embodiment of the invention.

FIG. 6 illustrates a fragrance storage and supply assembly 300 in accordance with another embodiment of the invention. In this embodiment, in place of cap 104 and connection member 104*a*, a cover 110 may be provided to cover the hollow portion 103 of the receiving assembly 100 as the receiving assembly 100 is rotated from the filling position to the accommodation position. The cover 110 may be fixed to the front supporter 5 of the dryer by using any applicable type of fixing elements, such as screws, bolts, adhesive, or the like (not shown). Hence, when the user rotates the receiving part 102 of receiving assembly 100 to the accommodation position, the hollow portion 103 is automatically covered. Conversely, when the user rotates the receiving part 102 of the receiving assembly 100 to the filling position, the hollow portion 103 is automatically opened to conveniently allow the fragrance solution to be poured therein. To ensure a seal between the hollow portion 103 and the cover 110, a sealing member (not shown) such as a cross-sectionally square, rectangular, or round gasket may be disposed on the lower surface of the cover 110, and/or at an upper surface of the hollow portion 103. The sealing members may be disposed at positions corresponding to one another.

Figure 7:
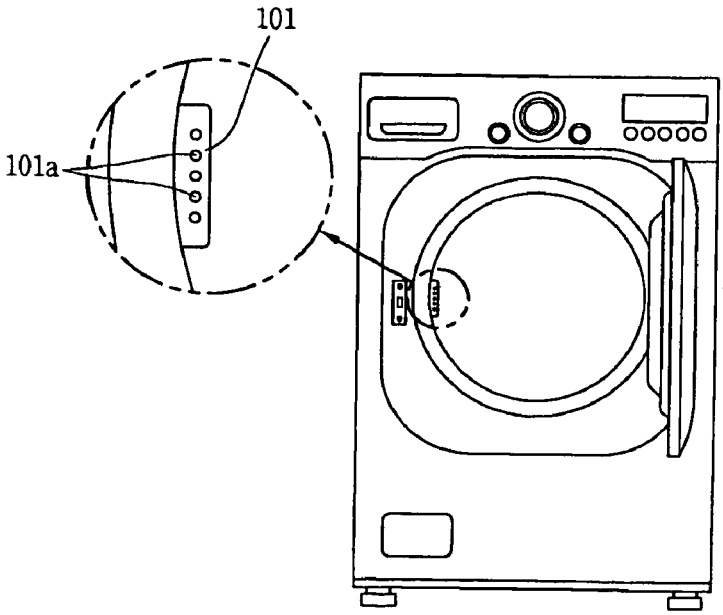
FIG. 7 is a view showing a handle of a receiving assembly of a fragrance storage and supply assembly in accordance with another embodiment of the invention, as viewed from the outside the laundry dryer with the door 10 open.

FIG. 7 is a view showing a handle 101 of a receiving assembly of a fragrance storage and supply assembly in accordance with another embodiment of the invention, as viewed from the outside a laundry dryer with the door 10 open. The handle 101 may be located at a position that is readily viewed by a user upon opening the door 10. Thus, the user can rotate the receiving part of the receiving assembly by grasping and pulling or pushing the handle 101. The handle 101 may also be provided with a display 101*a* to display the amount of fragrance solution remaining in the storage chamber 200. The level sensor 201 may be located at the lower portion of the storage chamber 200 to provide information as to the amount of fragrance solution remaining in the storage chamber 200. When the fragrance solution level drops below a predetermined point, the level sensor 201 may signal this state to the controller 14. The controller 14 may then send a signal to display 101, to display that the fragrance level is low and/or a refill is needed.

Preferably, the display 101*a* is configured to employ light emitting elements/diodes such as LED's. Thus, the display 101*a* may inform the user as to the amount of remaining fragrance solution in the storage chamber 200 by using LED indicators. The LEDs may light up in a manner to simulate the fragrance solution level, i.e. the three lower LEDs light up to indicate that the receiving assembly 100 is half-full. Similarly, if all LED's are lit this may indicate the storage chamber 200 is full and conversely if only the lowermost LED is lit this may indicate fragrance level is low and the storage chamber is in need of a refill. In the embodiment described, more than one level sensor 201 may be required to determine the level of fragrance solution in the storage chamber 200.

Hereinafter, a method for supplying fragrance by using a fragrance storage and supply assembly 300 in accordance with the embodiments of the invention will briefly be described. After the dryer has operated a predetermined number of fragrance storage and supply courses consuming substantially all of the fragrance solution contained in the storage chamber 200, the level sensor 201 detects a low level of the fragrance solution therein. The level sensor 201 then sends a signal to the controller 14 containing information as to the remaining level of fragrance solution. The controller then sends a signal to display the information on the control panel 12 of the dryer or the display 101*a* of handle 101, to alert a user to the lack of fragrance solution.

Alternatively, since the storage chamber 200 may be configured in an embodiment to be transparent or semi-transparent at window 202, the user can also determine the fragrance level by opening door 10 and viewing the level via window 202.

Once the lack of, or low level of, fragrance solution in storage chamber 200 is detected, the user can refill storage chamber 200 by grasping handle 101 of the receiving assembly 100 and rotating the receiving assembly 100 from the accommodation position to the filling position. After removing the cap 104 from the hollow portion 103 (as in the embodiment of FIGS. 5A and 5B), or after the hollow portion 103 is no longer substantially covered by the bottom of cover 110 (as in the embodiment of FIG. 6), a user may pour fragrance solution into hollow portion 103 of receiving assembly 100. The fragrance solution then flows from the receiving assembly 100 into the storage chamber 200 via tube 107.

The foregoing embodiments and advantages are merely exemplary and are not to be construed as limiting the disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A laundry dryer comprising:

a drum rotatably disposed within a cabinet;

a door coupled to a front of the cabinet;

a front supporter configured to support a side of the drum; and a fragrance storage and supply assembly disposed on the front supporter, the fragrance storage and supply assembly comprising a receiving part that is rotatably installed within the cabinet, wherein the receiving part is coupled to the front supporter by a hinge and is provided with a hollow portion configured to receive a liquid fragrance poured therein.

2. The dryer of claim 1, wherein the receiving part is provided with a handle extending along a side thereof such that the handle is visible from an outside of the dryer when the door is opened.

3. The dryer of claim 2, wherein the fragrance storage and supply assembly further comprises a storage chamber configured to store the liquid fragrance solution introduced into the hollow portion of the receiving part, and wherein the storage chamber is provided with a level sensor configured to detect a level of the liquid fragrance solution stored therein.

4. The dryer of claim 3, wherein the handle of the receiving part is provided with a display to display a level of fragrance solution in the storage chamber detected by the level sensor.

5. The dryer of claim 3, wherein a display of a control panel of the dryer is configured to display a level of fragrance solution in the storage chamber detected by the level sensor.

6. The dryer of claim 1, wherein the fragrance storage and supply assembly further comprises a storage chamber configured to receive a fragrance solution introduced into a hollow portion of the receiving part, the storage chamber having a side through which an amount of fragrance solution remaining in the storage chamber is discernable.

7. The dryer of claim 6, wherein the side of the storage chamber, through which an amount of fragrance solution remaining in the storage chamber is discernable, is visible from an outside of the dryer when the door is open.

8. The dryer of claim 3, further comprising:

a pump fluidly coupled to the storage chamber; and a nozzle fluidly coupled to the pump via a tube, the nozzle configured to dispense liquid fragrance solution into the drum.

9. The dryer of claim 1, wherein the front supporter is provided with a cover configured to cover and uncover the hollow portion of the receiving part in cooperation with rotation of the receiving part.

10. The dryer of claim 9, wherein a sealing member is disposed on a lower surface of the cover to form a seal between a bottom of the cover and a top of the hollow portion.

11. The dryer of claim 1, wherein the receiving part is provided with a cap attached thereto by a connection member, wherein the cap is configured to cover and uncover the hollow portion.

12. A laundry dryer comprising:

a cabinet defining an outer appearance of the laundry dryer;

a drum rotatably installed in the cabinet and configured to contain laundry therein;

a door to open and close a laundry passage, the laundry passage formed by an opening in the cabinet that is configured for passage of laundry into and removal of laundry from the drum; and a fragrance storage and supply assembly configured to dispense a liquid fragrance into the drum, the fragrance storage and supply assembly comprising:

a receiving part configured to receive the liquid fragrance therein;

a storage chamber, remote from the receiving part, in fluid communication with the receiving part, and configured to store the liquid fragrance received by the receiving part, a mount, coupled to the cabinet; and a hinge, rotatably joining the mount and the receiving part, wherein the receiving part is configured to rotate about the hinge from a space within an interior of the laundry dryer to a space exterior from the laundry dryer.

13. The laundry drier of claim 12, further comprising a level detecting device couple to the storage chamber.

14. The laundry dryer of claim 13, wherein the level detecting device is a window disposed at a side of the storage chamber.

15. The laundry dryer of claim 14, wherein the storage chamber is mounted within the cabinet such that the window is viewable from an outside of the dryer.

16. The laundry dryer of claim 13, wherein the level detecting device is a level sensor integrated with the storage chamber and configured to detect a level of liquid fragrance in the storage chamber.

17. The laundry dryer of claim 16, wherein an output of the level sensor causes a display to display a message to notify a user that the storage chamber requires additional liquid fragrance.

18. The laundry dryer of claim 12, wherein the cabinet further comprises a front supporter configured to support a front side of the drum, and wherein the mount is mounted to the front supporter.

19. The laundry dryer of claim 12, further comprising:

a pump fluidly coupled to the storage chamber; and a nozzle fluidly connected to the pump and configured to dispense liquid fragrance stored in the storage chamber into the drum.

* * * * *